US011944245B2

(12) United States Patent
MacNeil et al.

(10) Patent No.: US 11,944,245 B2
(45) Date of Patent: Apr. 2, 2024

(54) SOAP HOLDER

(71) Applicant: MACNEIL IP LLC, Bolingbrook, IL (US)

(72) Inventors: David F. MacNeil, Fort Lauderdale, FL (US); David S. Iverson, Oak Brook, IL (US)

(73) Assignee: MACNEIL IP LLC, Bolingbrook, IL (US)

( * ) Notice: Subject to any disclaimer, the term of this patent is extended or adjusted under 35 U.S.C. 154(b) by 446 days.

(21) Appl. No.: 17/344,324

(22) Filed: Jun. 10, 2021

(65) Prior Publication Data

US 2022/0395143 A1 Dec. 15, 2022

(51) Int. Cl.
*A47K 5/05* (2006.01)
*A47K 5/02* (2006.01)

(52) U.S. Cl.
CPC . *A47K 5/05* (2013.01); *A47K 5/02* (2013.01)

(58) Field of Classification Search
CPC ... A47K 5/05; A47K 5/02; A47K 5/00; A47K 5/03; A47K 5/04; A47K 5/18; A47J 47/20; A47J 43/287
USPC ..... 211/85.12, 70.7, 14; 248/37.3, 523, 539; 206/77.1; D6/536, 529, 532, 539
See application file for complete search history.

(56) References Cited

U.S. PATENT DOCUMENTS

D26,352 S * 12/1896 Snyder ..... D6/536
872,894 A * 12/1907 Burn ..... A47K 5/02 211/85.12
880,207 A * 2/1908 Foster ..... A47K 5/02 206/77.1
D47,188 S * 4/1915 Hipkins ..... D6/536
1,339,166 A * 5/1920 Collins ..... A47K 5/02 206/77.1
D71,116 S * 9/1926 Paye ..... D7/559
1,759,398 A * 5/1930 Hart ..... A47G 19/28 248/362
2,240,842 A * 5/1941 Gehring ..... A47G 19/30 248/37.3
D133,293 S * 8/1942 Anderson ..... D6/536
(Continued)

FOREIGN PATENT DOCUMENTS

CA 3077165 A1 * 4/2019 ..... A01K 5/0135
CN 307329724 5/2022
CN 307501663 8/2022

OTHER PUBLICATIONS

Showerring Soap Box Holder, posted Apr. 14, 2022 [online], [retrieved Oct. 27, 2022]. Retrieved from internet, https://www.amazon.com/SHOWERRING-Draining-Decorative-Plastic-Bathroom/dp/B09XXN42MQ (Year: 2022).

(Continued)

*Primary Examiner* — Jennifer E. Novosad
(74) *Attorney, Agent, or Firm* — Perkins IP Law Group LLC; Jefferson Perkins

(57) ABSTRACT

A soap holder has a base and a hollow pedestal upwardly extending from the base to a top end, at which is formed an upper limit or locus. The locus receives a bar of soap. At least one air hole is formed to communicate to the pedestal interior and to be disposed below the top end. Since almost all of the exterior surface of the soap bar is exposed to ambient air, the soap bar dries without creating a goopy mess. Curved surfaces of the soap holder aid in its cleaning.

22 Claims, 17 Drawing Sheets

(56) References Cited

U.S. PATENT DOCUMENTS

D141,789 S * 7/1945 Quinn ..... 206/77.1
D163,084 S * 5/1951 Biener ..... D6/536
2,900,757 A * 8/1959 Grimm, Jr. ..... A47K 5/05 248/205.8
2,973,601 A * 3/1961 McKnight ..... A47K 5/02 206/77.1
3,104,490 A * 9/1963 Cornell ..... A47K 5/02 248/690
3,164,356 A * 1/1965 Zajaczkowski ..... A47K 5/05 248/688
3,326,386 A * 6/1967 Goodloe ..... A47G 19/28 248/346.03
D211,888 S * 8/1968 Hall et al. ..... D6/536
D213,134 S 1/1969 Merritt
3,476,254 A * 11/1969 Gaffney ..... A47K 5/04 312/351
3,688,895 A * 9/1972 Wilson ..... A47K 5/04 206/557
D228,842 S 10/1973 Tegner
D234,173 S * 1/1975 Tegner ..... D6/536
3,955,786 A * 5/1976 Duddy ..... B60R 13/00 248/539
4,151,972 A * 5/1979 Allegro ..... B60N 3/083 D6/536
D270,799 S * 10/1983 Creske ..... D7/553.6
4,445,808 A 5/1984 Arya
4,446,178 A * 5/1984 Daugherty ..... A47K 5/04 248/316.1
4,506,784 A * 3/1985 Kanfer ..... A45D 40/0075 220/276
D358,517 S 5/1995 Sharpe
5,441,164 A * 8/1995 Beck ..... A47G 19/06 220/574
D363,046 S * 10/1995 Rimback ..... D11/155
D375,859 S 11/1996 Sharpe
5,685,517 A * 11/1997 Salibra ..... A01K 97/10 248/539
6,192,792 B1 * 2/2001 Gremillion ..... A47J 43/18 99/347
D453,647 S 2/2002 Gottwald
D463,250 S 9/2002 Valentz
D485,105 S 1/2004 Loor
6,889,953 B2 * 5/2005 Harbaugh ..... E04H 12/2246 248/539
6,966,445 B1 * 11/2005 Johanna ..... A47K 5/05 211/85.12
D568,112 S * 5/2008 Epstein ..... D7/554.2
D587,529 S * 3/2009 Pratt ..... D7/553.8
7,677,386 B1 * 3/2010 Kumar ..... A47K 5/03 206/77.1
D628,047 S 11/2010 Craig
D669,717 S * 10/2012 Legreca ..... D6/536
D681,887 S * 5/2013 Fang ..... D30/132
D681,888 S * 5/2013 Fang ..... D30/132
D689,245 S * 9/2013 Rowe ..... D30/132
D808,189 S * 1/2018 Cohen ..... D6/536
D823,022 S * 7/2018 Goding ..... D6/536
D867,668 S * 11/2019 Lotti ..... D28/73
D872,381 S * 1/2020 Lee ..... D30/132
D882,882 S * 4/2020 MacNeil ..... D30/129
D887,650 S * 6/2020 MacNeil ..... D30/129
D901,927 S * 11/2020 Goding ..... D6/536
D917,793 S * 4/2021 Huang ..... D30/132
D948,081 S 4/2022 Goldberg
D972,788 S * 12/2022 Milsom ..... D30/132
D976,611 S * 1/2023 MacNeil ..... D6/536
D976,612 S * 1/2023 MacNeil ..... D6/536
2004/0200359 A1 * 10/2004 Snider ..... A47J 27/04 99/446
2005/0189242 A1 * 9/2005 Vitye ..... A47K 5/04 206/77.1
2008/0083628 A1 * 4/2008 Sines ..... A47K 5/03 248/346.11
2008/0302927 A1 * 12/2008 Tredinnick ..... A47K 5/03 248/176.1
2012/0175484 A1 * 7/2012 Hao ..... F16B 47/00 248/363
2014/0299275 A1 * 10/2014 Melet ..... A47K 5/03 156/580
2015/0257611 A1 * 9/2015 Huang ..... A47K 5/03 206/77.1
2022/0395143 A1 * 12/2022 MacNeil ..... A47K 5/02

OTHER PUBLICATIONS

Self-Drain Soap Holder, posted Apr. 14, 2022 [online], [retrieved Oct. 18, 2021]. Retrieved from internet, https://www.amazon.com/Container-Suction-Punched-Draining-Bathroom/dp/B09JNLV262?th=1 (Year: 2021).
Dock Base Plate, Posted unknown [online], [retrieved Oct. 31, 2021]. Retrieved from internet, https://www.amazon.com/Dock-Edge-Plate-2-125-Punch/dp/B00633MWCC?th=1 (Year: 2022).
Telescoping Flagpole Deck Mount, posted unknown [online], [retrieved Oct. 31, 2021]. Retrieved from internet, https://www.libertyflagpoles.com/products/telescoping-flagpole-deck-mount (Year: 2022).

* cited by examiner

SOAP HOLDER

BACKGROUND OF THE INVENTION

A bar of soap is a universal skin cleaning material. As it is being used, a portion of it will enter a goopy or liquid phase. After it has been used, a user typically puts the bar of soap back in a soap dish or shower shelf provided for the purpose. Some of the liquified portion will coat the interior of the dish or surface of the shower nook, building up an unusable mess which later must be cleaned off of each surface the softened bar contacted.

Wire frame soap holders or trays are known, which support the soap bar such that most of the undersurface of the soap bar is not contacted. However, these wire frame devices allow water and goop to drip off of the soap bar in an unrestricted fashion. A need therefore continues to persist for a soap holder that will permit virtually all of the surface of the soap bar to dry after use, but which will contain or restrict drippings off of the bar until this happens.

SUMMARY OF THE INVENTION

According to one aspect of the invention, a soap holder is provided that has a base with a general top surface. A hollow pedestal upwardly extends from the general top surface and is formed around a vertical axis. The outer surface of the pedestal is curved and endless. An inner surface of the pedestal also is curved and endless, and defines a pedestal interior. The outer and inner surfaces of the pedestal meet at a top end of the pedestal by way of an upwardly convexly curved transition. A maximum length of the top end, as measured in a horizontal direction, is many times smaller than either the length or the width of the general top surface of the base. A curved transition, with a minimum curve radius of at least about 0.25 inch, joins the outer surface of the pedestal to the general top surface of the base. At least one air hole opens onto the interior of the pedestal and is located below the pedestal top end.

In one embodiment, at least three feet extend below a bottom surface of the base to space that bottom surface from a holder support surface, such as a shower stall nook or kitchen counter. The feet each have a lower end that is downwardly convexly curved or terminates in an approximate point, so as to present a substantially single-point or single-line locus of contact to the holder support surface.

One embodiment of the holder is provided for a dry environment such as a kitchen counter or a vanity top. In this embodiment, a peripheral lip upwardly extends from the general top surface of the base. The lip is located at an outer margin of the base general top surface. One or more air holes are made through the pedestal wall so as to communicate the pedestal interior to ambient air. In one embodiment, these air holes take the form of slots which downwardly extend from the top end of the pedestal. The slots are at least % inch wide so as to allow their easy cleaning. In this kitchen/vanity embodiment, the bottom of the pedestal interior is closed.

Another embodiment of the holder is provided for a wet environment such as near a bath or in a shower. In this embodiment, the general top surface of the base is upwardly convexly curved, or downwardly and outwardly sloped, so as to shed water, soap and other particulate matter. The air hole is made in the bottom of the pedestal, so as to allow any contents accumulated in the pedestal interior to drain.

In use, a soap bar is placed on the top end of the pedestal, where it is contacted only by a thin ring or locus of the pedestal. Outside of this ring, the exterior surface of the soap bar is exposed to drying air. Inside of this ring, the exterior surface of the soap bar is exposed to drying air that enters the pedestal interior by way of the one or more air holes.

Prior to drying, any drips from the soap bar will be caught either by the interior of the pedestal or by the general top surface of the base. In the kitchen/vanity embodiment, such drippings are contained by the peripheral lip of the base or in the closed bottom end of the pedestal, from where they may be later easily cleaned. In the bath/shower embodiment, such drippings as are caught in the pedestal interior are passed through to below the base, while drippings impinging on the general top surface will be shed because the general top surface is convex.

In one embodiment, the dimensions of certain curved transitions and other features of the soap holder are selected such that the holder may be easily cleaned by a human finger or other blunt instrument. This is why the bottom of the pedestal interior in one kitchen/vanity embodiment is concavely curved and why there is a large curved transition between the outer surface of the pedestal and the general top surface of the base. In the kitchen/vanity embodiment, the preferred slots are large enough to admit a human finger, and are concavely curved at their bottom ends for optimum cleaning. In another kitchen/vanity embodiment, the center of the bottom of the pedestal interior is upwardly convex, and the pedestal slots extend down to the floor, so as to encourage liquified soap to exit the pedestal interior.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
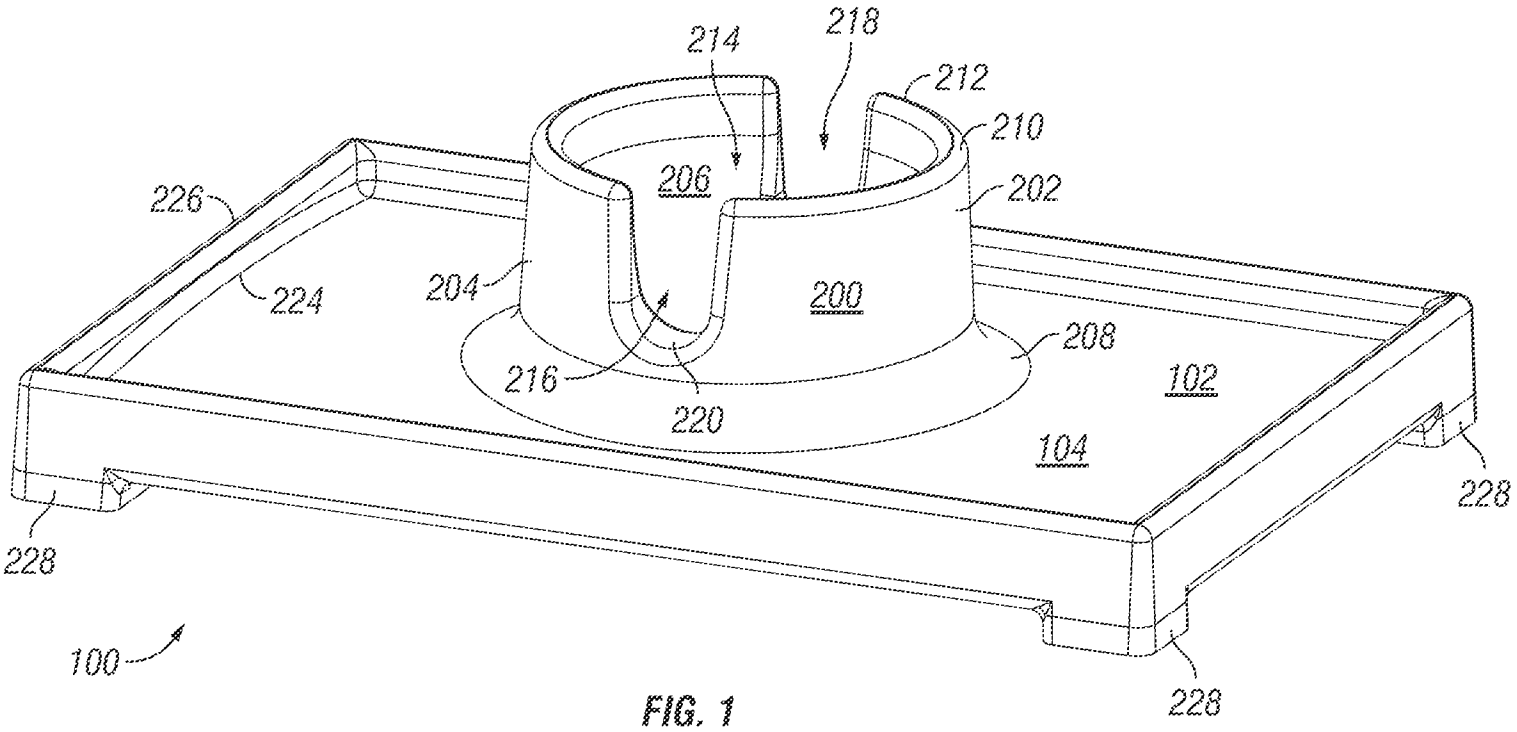
FIG. 1 is a top perspective view of a first embodiment of the invention, suitable for use in a dry environment such as a kitchen counter or vanity.

A first embodiment of the invention is shown generally at 100 in FIGS. 1-6. Referring first to FIG. 1, the soap holder 100 has a base 102 with a flat and horizontal general top surface 104. A hollow pedestal 200 is formed around a vertical axis $X_1$ (FIG. 2) and in the illustrated embodiment is located at the center of the base 102. The hollow pedestal 200 upwardly extends from the general top surface 104. The pedestal 200 and the base 102 may be integrally molded of a tough thermoplastic such as polypropylene or ABS.

In the illustrated embodiment, an outer surface 202 of a pedestal sidewall 204 is formed as a surface of rotation around axis $X_1$. Similarly, an inner surface 206 of pedestal sidewall 204 is formed as a surface of rotation around axis $X_1$. In the illustrated embodiment, these surfaces are substantially cylindrical, although not completely so; preferably they have a small angle of draft for the purpose of moldability.

The pedestal 200 could instead take other shapes, such that the surfaces 202, 206 of its sidewall would no longer be surfaces of rotation around axis $X_1$. For example, pedestal 200 could have an oval or elliptical cross section. It is preferred, however, that the surfaces 202, 206 be endlessly curved in cross section, so as to present no abrupt corners.

A junction 208 between pedestal outer surface 202 and general top surface 104 takes the form of an endless concave curved transition, with a minimum radius $R_1$ (see FIG. 5) of at least ¼ inch. This prevents the occurrence of a corner in which dirt, etc. could accumulate and makes the junction 208 easy to clean. Many of the transitions between surfaces of the soap holder 100 have such curved surfaces with this in mind.

The pedestal outer surface 202 extends from junction 208 upwardly until it meets upwardly convex top end 210. Top end 210 is a curved transition between outer surface 202 and inner surface 206. The top end 210 has an upper limit or locus 212 that in this illustrated embodiment is a circle, of a single line in width, and which is broken in two places. Upper limit or locus 212 should reside in a horizontal plane.

Figure 4:
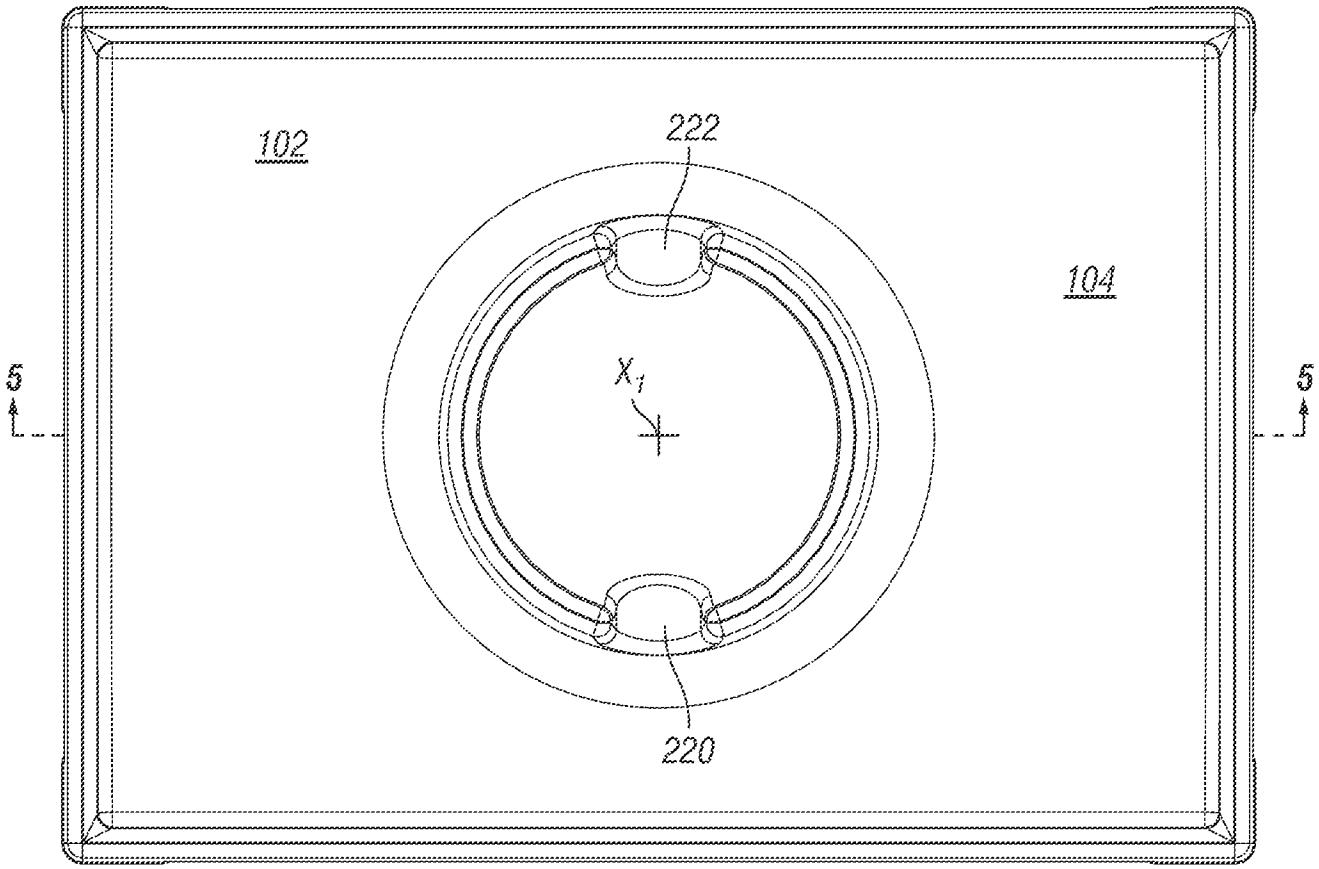
FIG. 4 is a top view of the soap holder shown in FIG. 1.

The inner surface 206 helps define a pedestal interior 214. At least one airhole, and in this embodiment two such airholes 216 and 218 in the form of slots, extend from the pedestal interior to the exterior. Slots 216 and 218 are disposed below top end 210. Slot 216 and 218 are open at the top and terminate at their bottoms in respective curves 220, 222 (curve 222 is seen in FIG. 4). The slots 216, 218 are wide enough to make them easy to clean and their surfaces make convexly curved transitions between pedestal outer surface 202 and pedestal inner surface 206. In the illustrated embodiment, the airholes 216 and 218 are angularly spaced from each other by 180 degrees.

In this embodiment, the general top surface 104 of the base 102 has a perimeter 224 at which upwardly extends a peripheral lip 226. The lip 226 is designed to contain any drippings from a soap bar which may collect on the surface 104. Also located at or near the perimeter 224 are at least three, and in the illustrated embodiment four, feet 228 that elevate the base 102 above any flat surface on which the soap holder 100 is placed. The feet 228 are spaced apart from each other, and from axis $X_1$, so as provide stability to the holder 100 as it rests on the support surface.

Figure 2:
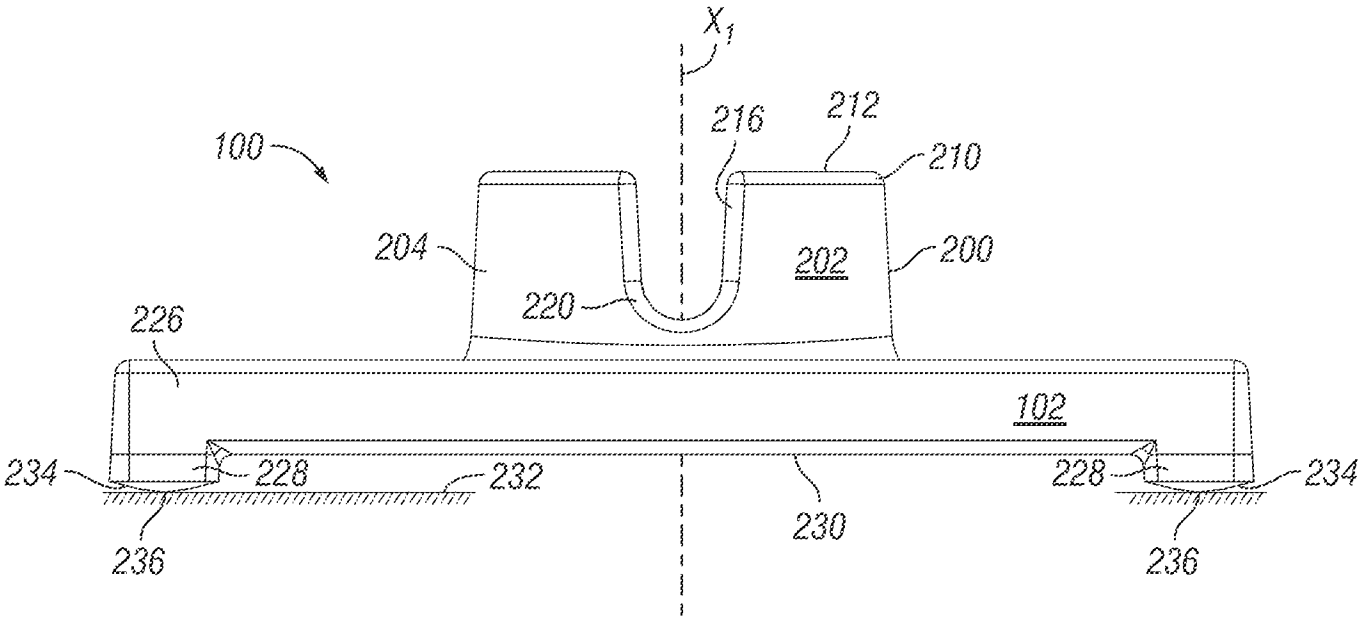
FIG. 2 is an elevational view of the soap holder shown in FIG. 1.
Figure 3:
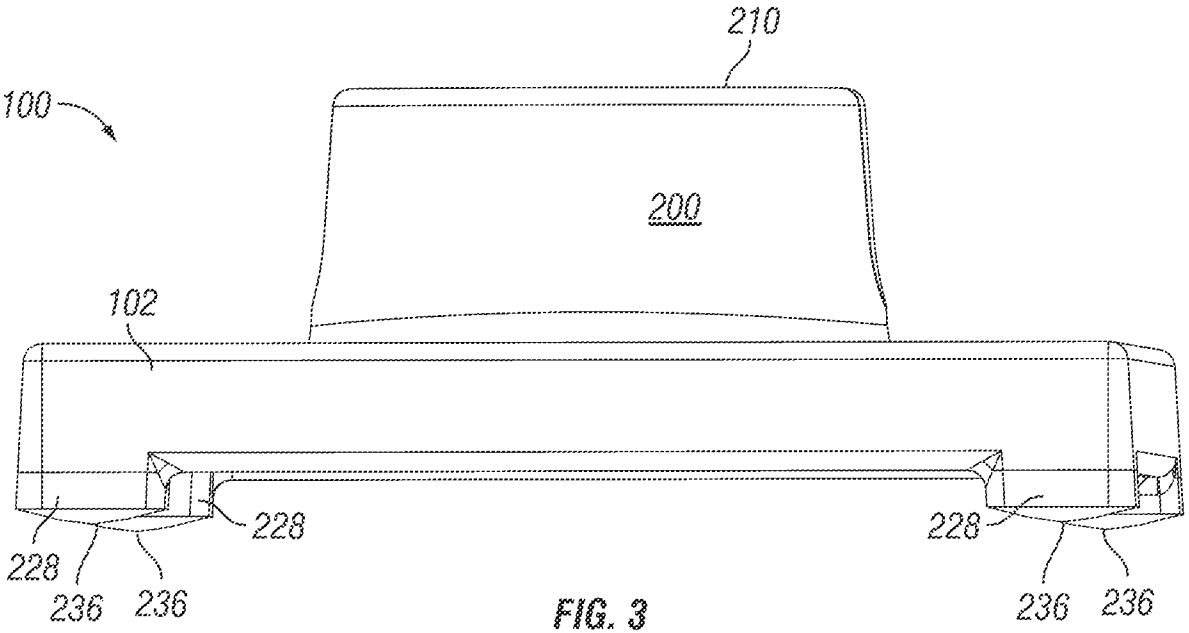
FIG. 3 is an end view of the soap holder shown in FIG. 1.

As seen in FIG. 2, the base 102 has a bottom surface 230 that is elevated above the support surface 232 by the feet 228. In this illustrated embodiment, each foot 228 has a roughly square cross section until its lower end surface 234 is approached. End surfaces 234 are roughly shaped like rounded and inverted pyramids, so that each of them terminate in a locus that approximates a single point 236. In this illustrated embodiment, only point loci 236 make contact with the support surface 232, which can be a vanity top or kitchen counter. This reduces the surface area near which drippings and the like can gather, making the support surface 232 and the holder 100 easier to keep clean.

In the embodiment shown in FIGS. 1-6, the shape of base 102 is rectangular. This is best seen in FIG. 4. The base 102 should have an area that exceeds, by a comfortable margin, the horizontal area of a bar of soap that it is provided to hold. Oftentimes soap bars will take other shapes such as ones that are oval or circular. For a holder that is specifically provided for a particular soap bar shape, the base 102 could emulate the shape of the soap bar, but be somewhat wider and longer. For example, for oval soap bars, the base 102 could take an oval shape.

Figure 5:
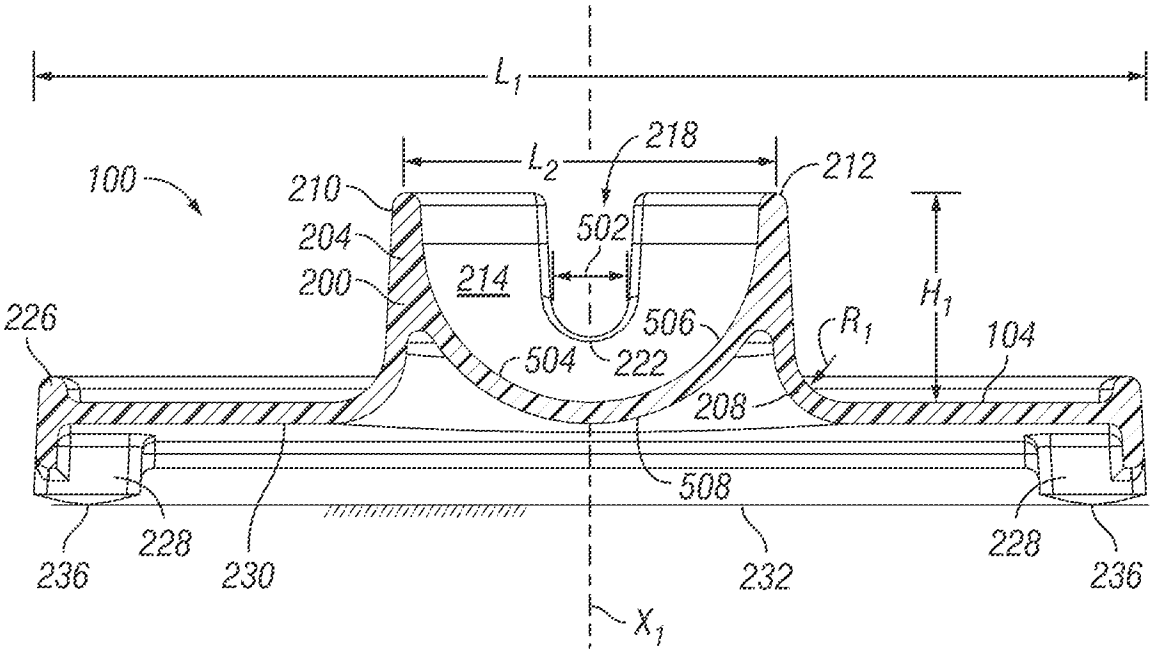
FIG. 5 is a lengthwise axial sectional view taken substantially along Line 5-5 of FIG. 4.

The overall proportions of the soap holder 100 are best seen in FIG. 5. Regardless of shape, holder 100 has a length $L_1$ in the range of about 4.5 to about 6 inches (about 11 to about 15 cm), and in one embodiment is about 5.25 inches (about 13 cm). The length $L_1$ is greater than or equal to the width (not shown) of the base 102, taken in a direction orthogonal to axis $X_1$ and length $L_1$. A maximum length $L_2$ across the top end 210 is many times smaller than length $L_1$. Length $L_2$ is measured in the plane containing axis $X_1$ across the upper limits or locus 212 of the top end 210. In the illustrated embodiment, the upper limit or locus 212 is circular in shape and length $L_2$ is a diameter of this circle. In other embodiments, the upper limit 212 could take other shapes, and in that event length $L_2$ will be the largest span across the interior 214 of the pedestal 200. Maximum length $L_2$ may be chosen in the range of about 1 to about 3 inches (2.5 to 5 cm), and in the illustrated embodiment is about 1.6 inches (4 cm).

The length $L_1$ is chosen to be comfortably larger than a length of a new bar of soap it is meant to support. The length $L_2$ is selected such that the soap bar will be supported by one or more curved line segments that have many points widely spaced from each other and from axis $X_1$. The wider dimension $L_2$ is, the more resistance there will be to the soap bar tipping off of the pedestal 200. On the other hand, $L_2$ should not be so wide that a partially used, but still usable, soap bar cannot rest across locus 212.

Upper limit or locus 212 is located at a height $H_1$ above the top general surface 104 of the base 102. When a person grasps a soap bar, he or she usually does not grab it by the fingertips, but rather by more proximal points of the thumb and fingers. Therefore, when a user is placing a bar of soap on pedestal 200, his or her thumb and fingers will have a tendency to extend below locus 212. Height $H_1$ should be selected so that the user has a measure of "finger relief" when placing or taking up the soap bar. Height $H_1$ should therefore be at least % inch (1.9 cm) and in the illustrated embodiment is about 1 inch (2.5 cm).

The width of airholes or slots 216, 218 is selected to make them easy to clean. In the illustrated embodiment the slots 216, 218 taper somewhat from locus 212 to curved slot bottoms 220, 222. A width 502 of the curved slot bottoms 220, 222 may be about ½ inch (1.2 cm) and may be chosen to be larger than this.

A minimum radius $R_1$ of sidewall/base junction 208 should be chosen so that the junction 208 may be easily cleaned by a finger or like implement, and should be at least about ¼ inch (0.6 cm).

In the embodiment illustrated in FIGS. 1-6, a bottom 504 of the pedestal interior 214 is closed, so as to prevent drippings from the soap bar from impinging on support surface 232. An upwardly facing surface 506 of the bottom 504 should be concavely curved so as to not have any corners or facets in it. Drippings will collect on bottom 504, but, because this surface is continuously curved, bottom 504 will be easy to clean with a finger or like implement. In the illustrated embodiment, surface 506 may be hemispherical and have a diameter a little smaller than maximum length or diameter $L_2$.

A bottom surface 508 of the bottom 504 is continuous with and a part of the bottom surface 230 of the base 102. Lower surfaces 230, 508 are elevated well above support surface 232 by feet 228.

Figure 6:
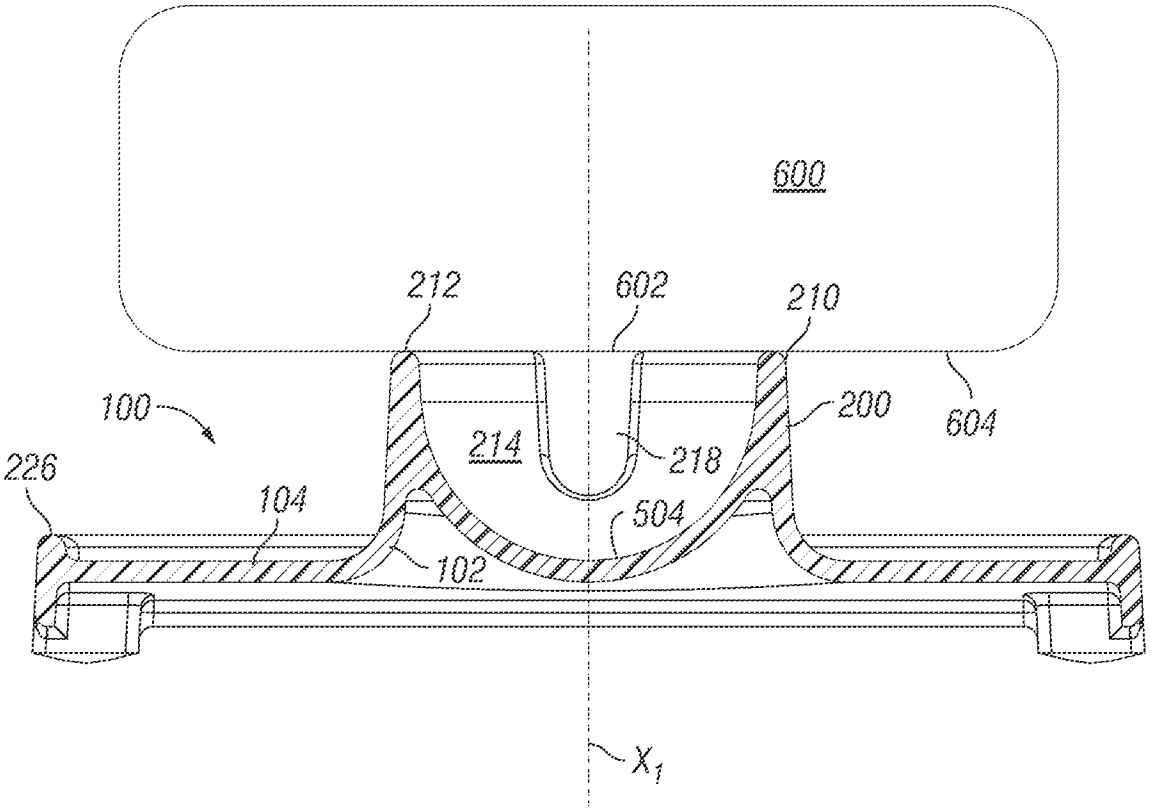
FIG. 6 is an axial sectional view similar to FIG. 5, but showing the support of a bar of soap.
Figure 7:
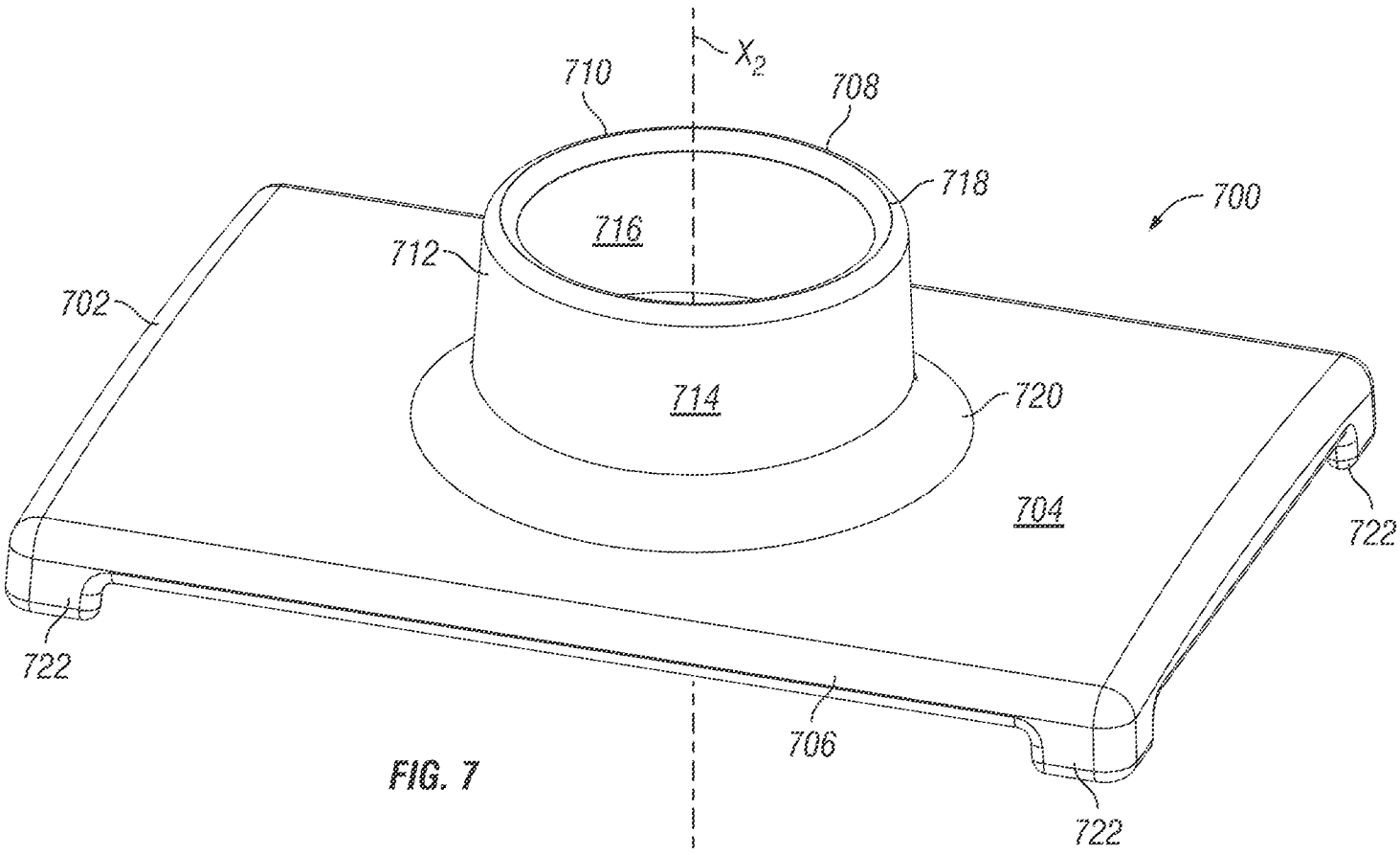
FIG. 7 is a top perspective view of a second embodiment of the invention, suitable for use in a wet environment such as beside a bath or in a shower.

In FIG. 6, a representative soap bar 600 has been placed on soap holder 100, across the thin locus 212. Typically, a user will put bar 600 in this position and permit it to dry. Any drippings off of bar 600 will be caught by top surface 104 or bottom 504. Such drippings as are caught by top surface 104 will be retained by peripheral lip 226. The only points of soap bar 600 not exposed to the air adjoin thin, circular locus 212. A soap bar surface portion 604 located outside of locus 212 (most of the surface of bar 600) will be exposed to the air directly. A soap bar surface portion 602 located interiorly of locus 212 will be exposed to drying air through slots 216, 218. In this way, almost all of the soap bar surface may dry.

FIGS. 7-12 depict an embodiment of the invention that is suited for placement in a shower, beside a bath or in another wet environment. This soap holder 700 has a base 702 with a top surface 704 that is outwardly and downwardly sloped, or upwardly convex. In this way, soap drippings, water and other detritus will have a tendency to be shed toward and over a base periphery 706. Notably the periphery 706 has no upstanding peripheral lip.

A pedestal 708 upwardly extends from surface 704 to a top end 710. A sidewall 712 of the pedestal has an outer surface 714 and an inner surface 716, which meet at top end 710 by way of an upwardly convexly curved transition. An upper limit or locus 718, in the illustrated embodiment, is circular and uninterrupted, and presents a thin-line locus or line of contact on which the soap bar (not shown) rests. Locus 718 is disposed in a horizontal plane.

Outer surface 714 is joined at its lower end to surface 704 by means of a junction 720, which should be an upwardly concave curved transition and preferably is endless. Outer surface 714, inner surface 716 and junction 720 may all be formed as surfaces of rotation around a vertical axis $X_2$, although other curved surfaces may be employed instead. In any event surfaces 714, 716 and 720 should be smoothly curved so as to avoid sharp corners. At least three, and in the illustrated embodiment four, feet 722 elevate the base 702 above a support surface. The feet 722 are disposed at or near the periphery 706 so as to be spaced apart from each other and from axis $X_2$.

Figure 8:
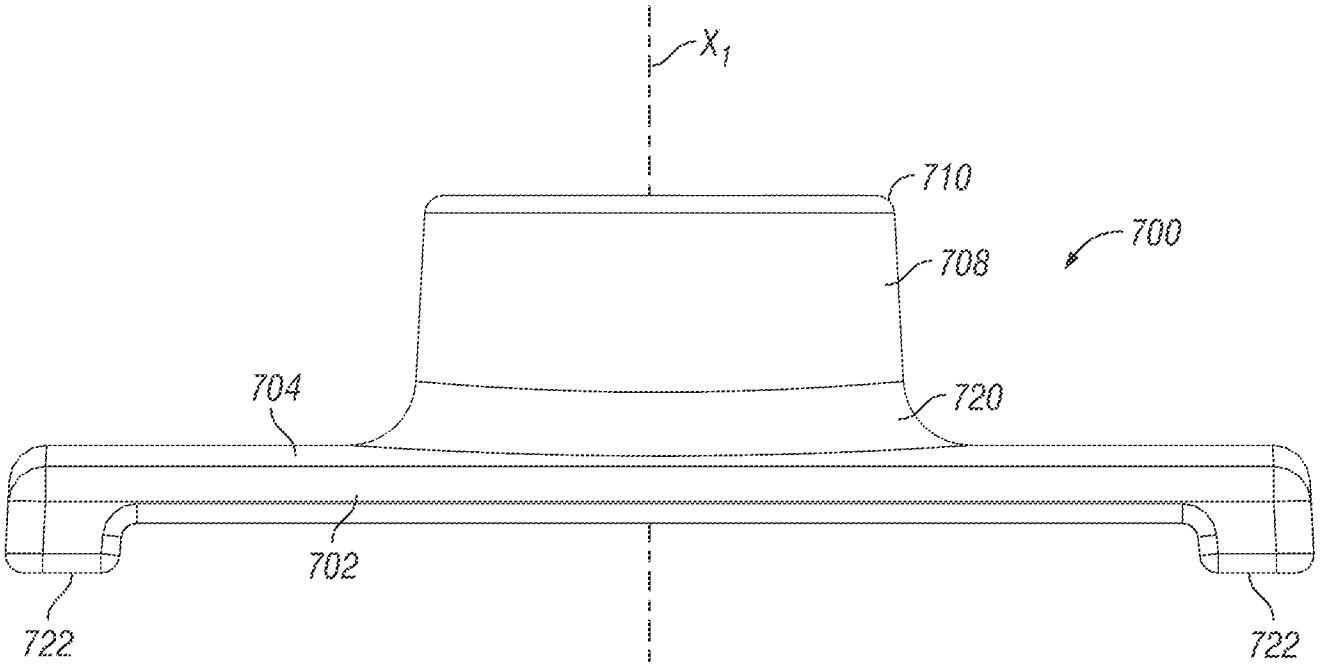
FIG. 8 is an elevational view of the soap holder shown in FIG. 7.
Figure 9:
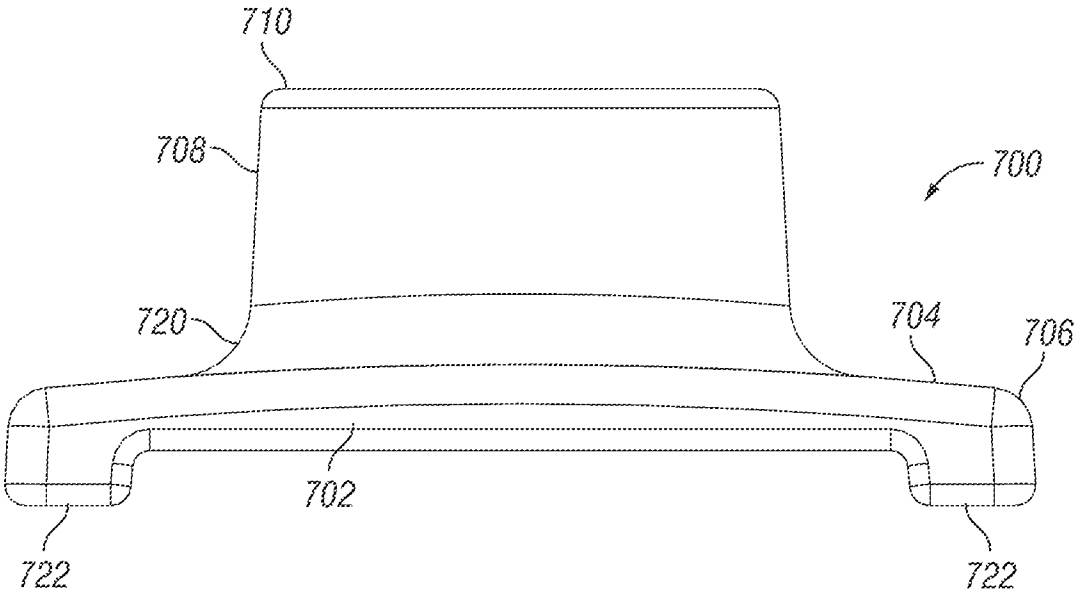
FIG. 9 is an end view of the soap holder shown in FIG. 7.

In this illustrated embodiment, surface 704 is convex, or downwardly and outwardly sloped, only in a front-to rear direction, as is shown in FIG. 9. It is straight and horizontal in a side-to-side direction, as is shown in FIG. 8. Surface 704 is therefore convex in two directions rather than three, but in an alternative embodiment it could be convex or downwardly and outwardly sloped both side-to-side and front-to-rear.

Figure 10:
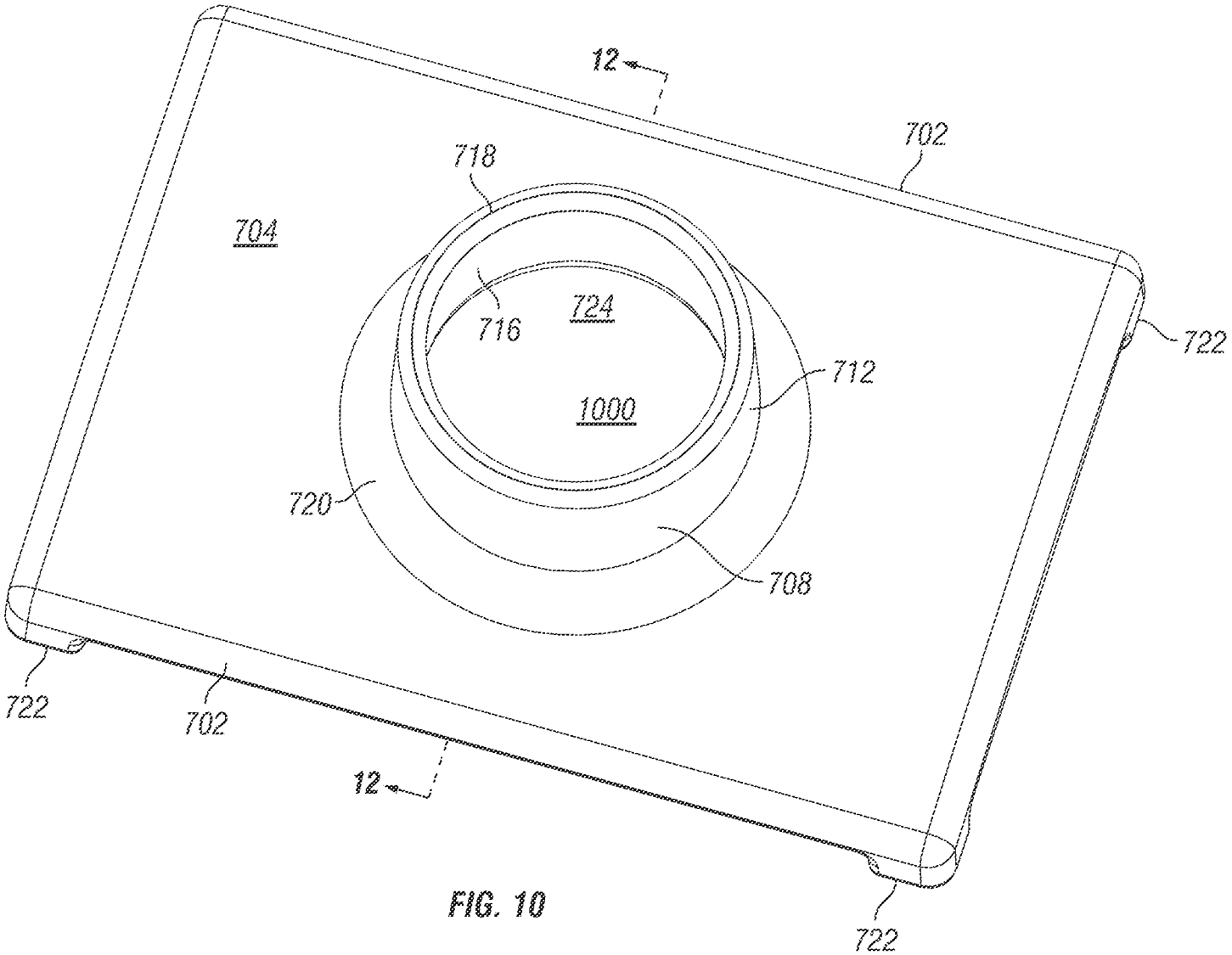
FIG. 10 is a further top perspective view of the soap holder shown in FIG. 7.
Figure 11:
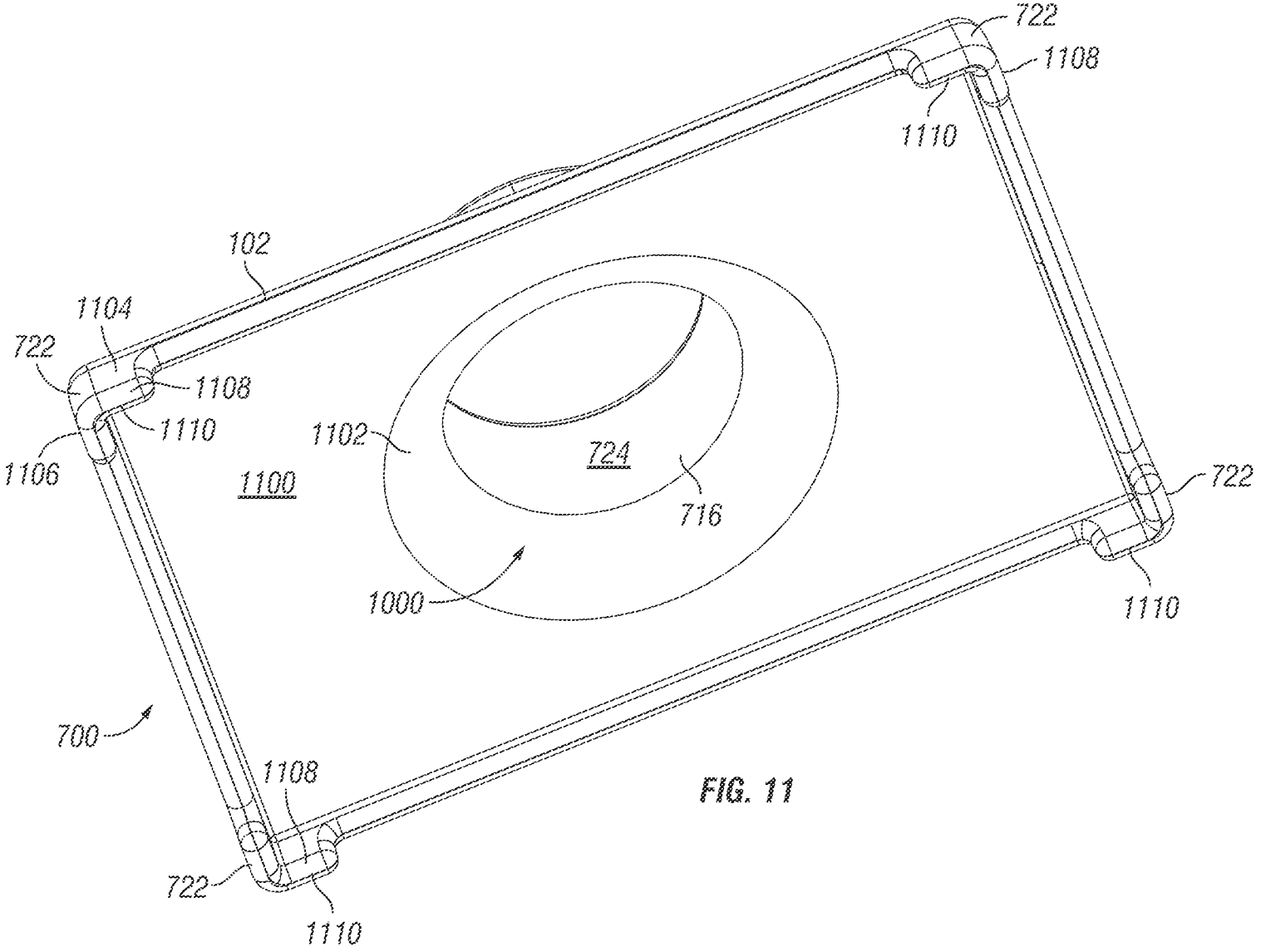
FIG. 11 is a bottom perspective view of the soap holder shown in FIG. 7.

In the embodiment shown in FIGS. 7-12, the location of the airhole to the interior 724 of the pedestal 708 is different from those shown in FIGS. 1-6: as seen in FIG. 10, it is created simply by omitting the bottom of the pedestal interior. The coaxial airhole 1000 communicates pedestal interior 724 to the air volume below the base 702. Therefore, when a soap bar is placed on locus 718, the area of the soap bar interior to locus 718 will still be exposed to drying air. In FIG. 11, it is seen that inner surface 716 communicates with a bottom surface 1100 of the base 702 by means of a large curved transition 1102. Curved transition 1102 generally follows, but is offset from, the curved transition 720 on the top surface of the soap holder 700.

In this embodiment, drippings from the soap bar simply pass completely through the pedestal interior 724 to be deposited on the support surface. This is an appropriate disposition in a wet environment such as a shower stall. No attempt is made to retain such drippings, and instead the structure is modified to shed such drippings off or through the holder 700 and minimize their accumulation on the surfaces of holder 700.

In FIG. 11, it can also be seen that the shape of feet 722 is different from that of feet 228 (FIGS. 1-6). Each foot 722 is formed from the junction of a lengthwise wall 1104 and a widthwise wall 1106, in approximately an "L" shape. Each foot 722 downwardly terminates in a rounded end 1108. A lower limit or locus 1110 is a single line that is bent 90 degrees through a curved transition, and which is disposed in a horizontal plane with the other loci 1110. Four such linear loci 1110 will be the only points at which the holder 700 touches the support surface. This minimizes the area in which drippings might be trapped and then congeal.

Figure 12:
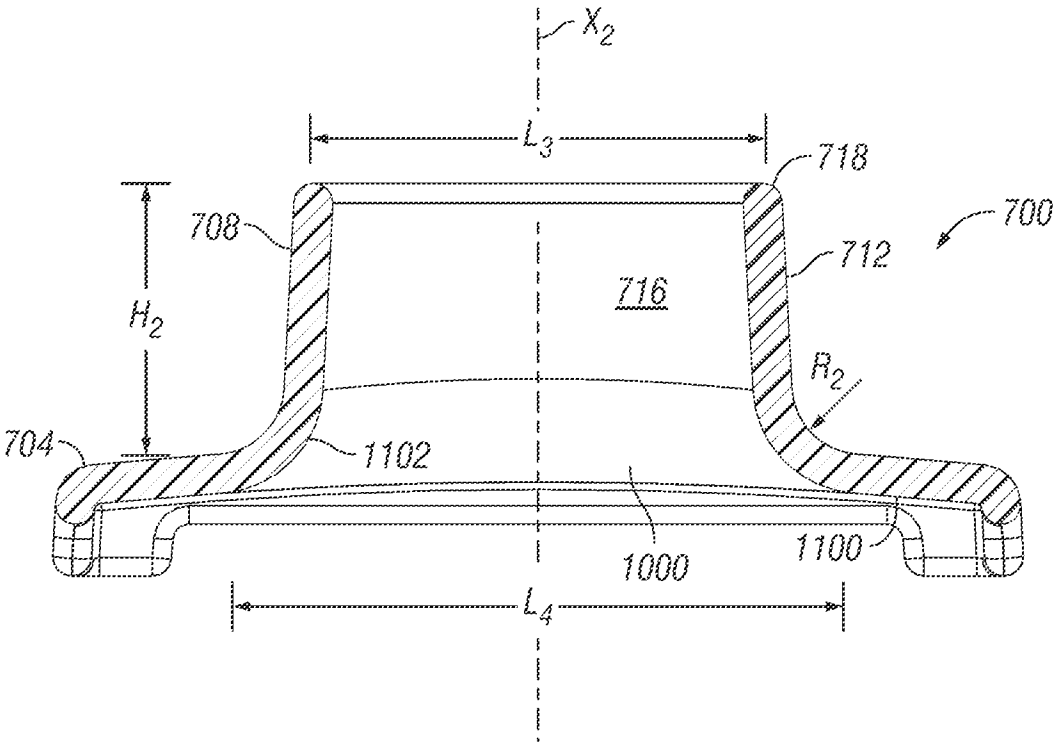
FIG. 12 is a widthwise axial sectional view taken substantially along Line 12-12 of FIG. 10.
Figure 13:
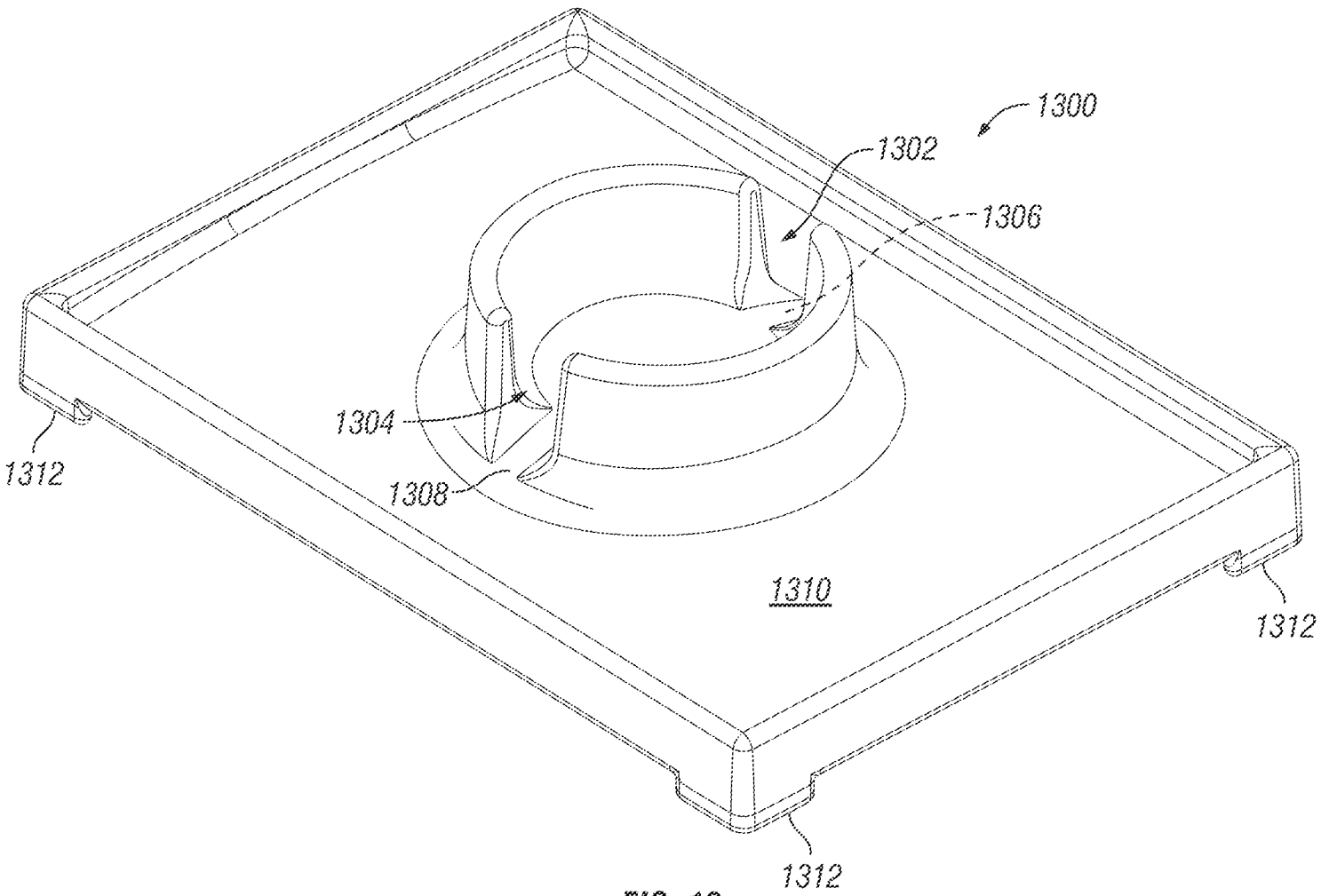
FIG. 13 is a top perspective view of a third embodiment of the invention, suitable for a use in a dry environment such as a kitchen or vanity countertop.
Figure 14:
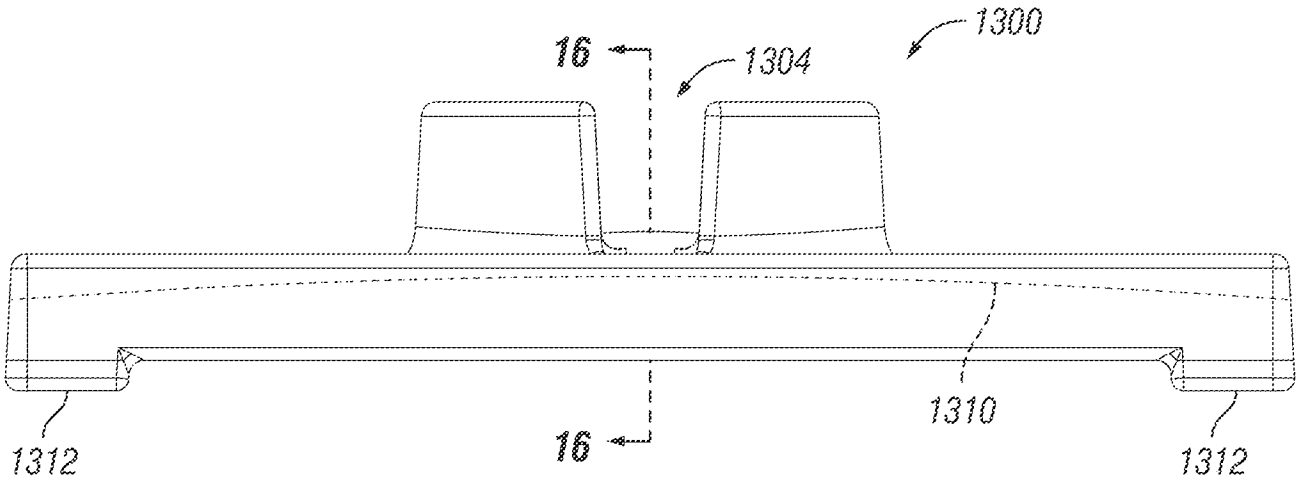
FIG. 14 is a front elevational view of the soap holder shown in FIG. 13.
Figure 15:
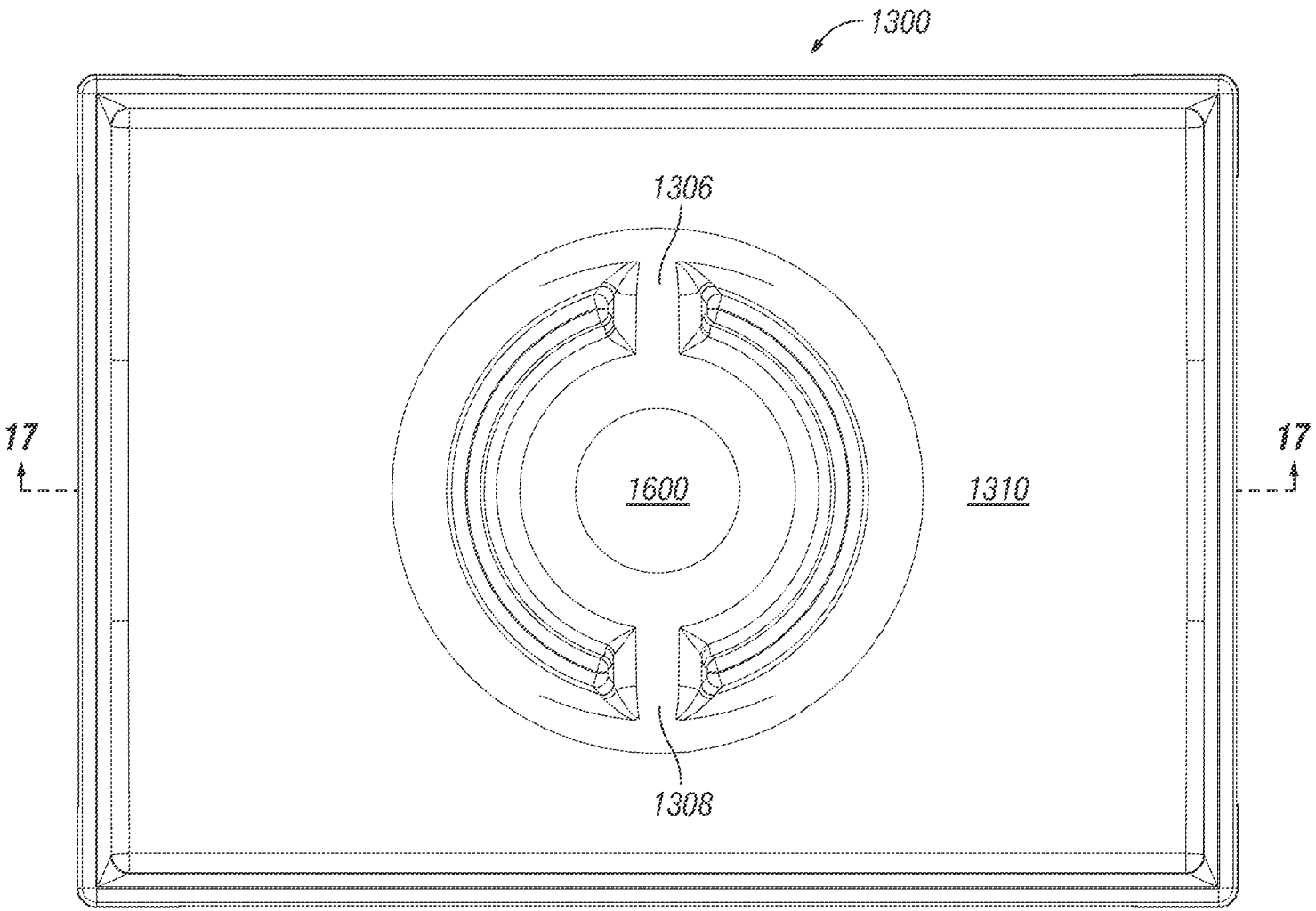
FIG. 15 is a top view of the soap holder shown in FIG. 13.
Figure 16:
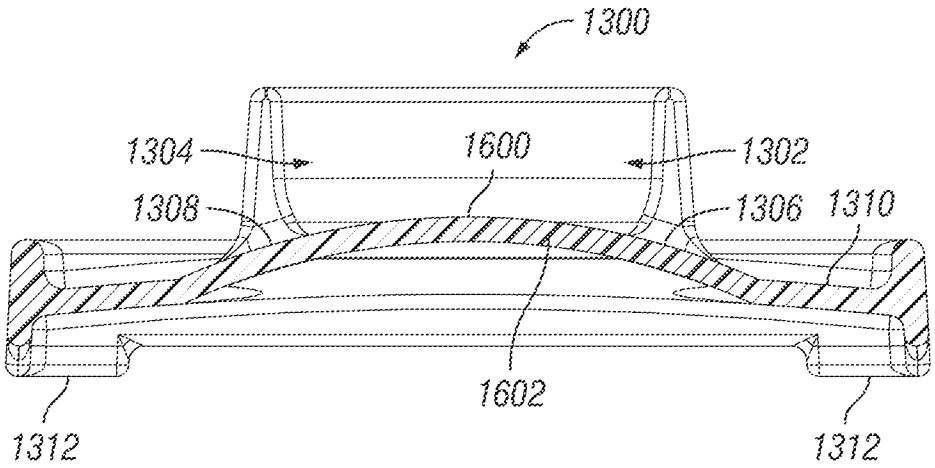
FIG. 16 is a widthwise sectional view taken substantially along Line 16-16 of FIG. 14.
Figure 17:
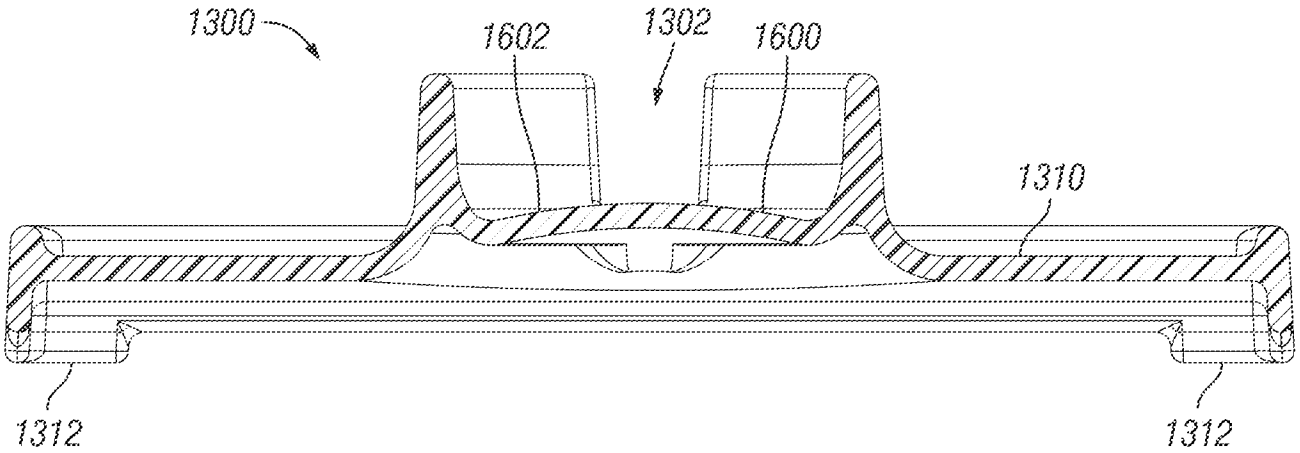
FIG. 17 is a lengthwise sectional view taken substantially along Line 17-17 of FIG. 15.

Most of the dimensions and proportions of soap holder 700 are similar to those given for soap holder 100. In FIG. 12, a maximum length $L_3$ (in this embodiment, a diameter) across locus 718 is in the range of about 1 to about 3 inches (2.5 to 5 cm) and in this embodiment is about 1.6 inch (4 cm). The width $L_4$ of the air hole 1000, taken near the end of curved transition 1102, is at least as great as and preferably is greater than length $L_3$. Even without curved transition 1102, length La would still be more than length $L_3$ because the pedestal sidewall is downwardly and radially outwardly tapered by a small amount for reasons of moldability. The minimum curved transition radius R2 should be at least ¼ inch. Height $H_2$, between horizontal locus 718 and the top surface 704, will vary depending on where on surface 704 the height is taken, as the surface 704 is downwardly and outwardly sloped. Nonetheless it should always be equal to or greater than about ¾ inch (1.9 cm) so as to afford a good amount of "finger relief", and in this embodiment is roughly about 1 inch (2.5 cm).

A soap bar (not shown, but similar to bar 600 in FIG. 6), if left resting on locus 718, will have almost all of its surface exposed to drying air. This is because ambient air can come into contact with that portion of the bar surface interior to locus 718 by passing through airhole 1000, and the rest of the soap bar surface is directly contacted by ambient air.

FIGS. 13-17 depict a third embodiment of the invention that is generally similar to the first embodiment shown in FIGS. 1-6. Below we discuss just the differences, all other structure and function of this soap holder 1300 being the same as that described for soap holder 100.

In holder 1300, the slots 1302, 1304 do not end in bottom curves but instead have bottoms 1306, 1308 that have elevations slightly higher than that of the neighboring areas of general top surface 1310, to which the bottoms 1306, 1308 transition. As best seen in the sectional views of FIGS.

16 and 17, a top surface 1600 of the pedestal floor 1602 is convex rather than concave. Bottoms 1306, 1308 are radially outwardly and downwardly sloped and preferably are continuations of the convex surface 1600; bottoms 1306 continuously and monotonically transition between the convex surface 1600 and the general top surface 1310 of the base. Therefore, drippings from the wet soap bar that fall on convex surface 1600 will have a tendency to flow radially outwardly, out of the slots 1302, 1304 and on to the general top surface 1310. Collecting the drippings on the general top surface 1310 makes their subsequent removal easier.

In this embodiment, there are provided four feet 1312 at the corners of the holder 1300. The feet 1312 are similar in shape to feet 722 of the second embodiment.

In summary, soap holders have been shown and described which permit the soap bar to completely dry between uses by exposing most of the soap bar surface to ambient air. While illustrated embodiments of the present invention have been described and illustrated in the appended drawings, the present invention is not limited thereto but only by the scope and spirit of the appended claims.

We claim:

1. A soap holder for holding a bar of soap, the soap holder comprising:

a base having a general top surface, the general top surface of the base having a length and a width;

a hollow pedestal upwardly extending from the general top surface of the base and formed around a vertical axis, the length and width of the general top surface of the base being orthogonal to the vertical axis and to each other, an outer surface of the pedestal being curved around the axis, an inner surface of the pedestal being curved around the axis and defining a pedestal interior, the outer surface of the pedestal and the inner surface of the pedestal defining a pedestal wall therebetween, the pedestal wall having a top end upwardly displaced from the general top surface of the base, the outer surface of the pedestal wall and the inner surface of the pedestal wall meeting at the top end in an upwardly convexly curved transition that is also curved around the axis, a maximum length of the top end taken in a horizontal direction being smaller than the smaller of the length and width of the general top surface of the base;

the outer surface of the pedestal making a junction with the general top surface of the base, the junction being an upwardly concave curved transition with a minimum upward curve radius of at least 0.25 inch, the concave curved transition also being curved around the axis; and at least one air hole disposed below the top end of the pedestal and communicating to the pedestal interior so as to admit air into the pedestal interior.

2. The soap holder of claim 1, wherein the outer surface of the pedestal and the inner surface of the pedestal are formed as surfaces of rotation around the vertical axis.

3. The soap holder of claim 1, wherein the maximum length of the top end falls within a range of about 1 to about 2 inches.

4. The soap holder of claim 1, wherein a greater of the length and width of the general top surface of the base falls within a range of about 4.5 to about 6 inches.

5. The soap holder of claim 1, wherein the base has a bottom surface downwardly displaced from the general top surface of the base, the base having an outer margin, at least three feet downwardly extending from the bottom surface of the base and displaced from each other and from the vertical axis, each foot located near the outer margin of the base, each foot terminating in a lower end which is downwardly convex or which approximates a point, so as to present substantially a single-line or single-point locus of contact to a holder support surface.

6. The soap holder of claim 1, wherein the interior of the pedestal has a closed bottom, the at least one air hole being made through the pedestal wall.

7. The soap holder of claim 6, wherein the at least one air hole is a slot that downwardly extends from the top end of the pedestal, the slot having a width orthogonal to the vertical axis that is at least ½ inch.

8. The soap holder of claim 7, wherein the slot has a lower end, the lower end of the slot formed as an upwardly concave curve.

9. The soap holder of claim 6, wherein the at least one air hole is one of a plurality of spaced-apart air holes made through the wall of the pedestal.

10. The soap holder of claim 1, wherein the pedestal has an upwardly concavely curved bottom, an upper surface of the bottom being continuous with the inner surface of the pedestal.

11. The soap holder of claim 1, wherein the pedestal has a bottom with an upwardly convexly curved surface and wherein the at least one air hole is a slot, a bottom of the slot monotonically transitioning from the convexly curved surface of the bottom to the general top surface of the base.

12. The soap holder of claim 1, wherein the base has an outer margin, a lip formed at the outer margin of the base, the lip upwardly extending from the general top surface of the base.

13. The soap holder of claim 12, wherein a maximum length of the at least one airhole, taken in a direction orthogonal to the vertical axis, is at least as great as the maximum length of the top end of the pedestal.

14. The soap holder of claim 1, wherein the interior of the pedestal has a bottom, the at least one airhole formed through the bottom of the pedestal.

15. The soap holder of claim 1, wherein a maximum length of the at least one air hole has a width orthogonal to the vertical axis of at least ¾ inch.

16. The soap holder of claim 1, wherein the general top surface of the base is upwardly convex so as to shed soap, water and other particulate matter.

17. The soap holder of claim 1, wherein a distance in a vertical direction from the top end of the pedestal to the general top surface of the base is at least about % inch.

18. A soap holder for holding a bar of soap, the soap holder comprising:

a base having a general top surface, the general top surface of the base having a length, a width and an area, the general top surface being upwardly convex so as to shed particles of soap, water and other particulate matter;

a hollow pedestal upwardly extending from the general top surface of the base and formed around a vertical axis, the length and width of the general top surface of the base being orthogonal to the vertical axis, an outer surface of the pedestal being curved around the axis, an inner surface of the pedestal being curved around the axis and defining a pedestal interior, the outer surface of the pedestal and the inner surface of the pedestal defining a pedestal wall therebetween;

the pedestal wall having a top end displaced from the general top surface of the base, the outer surface of the pedestal wall and the inner surface of the pedestal wall meeting at the top end in an upwardly convexly curved transition which also curves around the axis, a maximum length of the top end taken in a direction orthogonal to the axis being smaller than the length or width of the general top surface of the base;

the outer surface of the pedestal making a junction with the general top surface of the base, the junction being an upwardly concave curved transition with a minimum curve radius of at least 0.25 inch, the concave curved transition also curved around the axis; and the base having a bottom surface, at least three feet of the holder downwardly extending from the bottom surface of the base so as to elevate the bottom surface of the base above a support surface, a bottom of the pedestal having at least one airhole therethrough so as to admit air into the pedestal interior.

19. The soap holder of claim 18, wherein each of the feet has a bottom end that is downwardly convex or approximates a point, so as to present a substantially single-line or single-point locus of contact to the support surface.

20. A soap holder for holding a bar of soap, the soap holder comprising:

a base having a general top surface, the general top surface of the base having a length, a width and an area, the base having an outer margin, a peripheral lip of the base disposed at the outer margin and extending upwardly from the general top surface of the base;

a hollow pedestal upwardly extending from the general top surface of the base and formed around a vertical axis, the length and width of the general top surface of the base being orthogonal to the vertical axis, an outer surface of the pedestal being curved around the axis, an inner surface of the pedestal being curved around the axis and defining a pedestal interior, the outer surface of the pedestal and the inner surface of the pedestal defining a pedestal wall therebetween, the pedestal having a closed bottom, the pedestal wall having a top end displaced from the general top surface of the base, the outer surface of the pedestal wall and the inner surface of the pedestal wall meeting at the top end in an upwardly convexly curved transition that is also curved around the axis, a maximum length of the top end taken in a horizontal direction being smaller than the length or width of the general top surface of the base;

the outer surface of the pedestal making a junction with the general top surface of the base, the junction being a concave curved transition with a curve radius of at least 0.25 inch, the concave curved transition also being curved around the axis; and at least one air hole disposed below the top end of the pedestal and through the pedestal wall to admit air into the pedestal interior.

21. The soap holder of claim 20, wherein said at least one airhole comprises a slot downwardly extending from the top end of the pedestal, a width of the slot in a direction orthogonal to the axis being at least ¾ inch.

22. The soap holder of claim 20, wherein said at least one airhole is one of a plurality of airholes formed through the pedestal wall to be spaced apart from each other, a width of each of the plurality of airholes taken in a direction orthogonal to the axis being at least ¾ inch.

* * * * *